US007518579B2

(12) United States Patent
Kwak

(10) Patent No.: US 7,518,579 B2
(45) Date of Patent: Apr. 14, 2009

(54) LIGHT EMITTING PANEL AND LIGHT EMITTING DISPLAY

(75) Inventor: Won-Kyu Kwak, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 662 days.

(21) Appl. No.: 11/112,788

(22) Filed: Apr. 21, 2005

(65) Prior Publication Data

US 2005/0243038 A1 Nov. 3, 2005

(30) Foreign Application Priority Data

Apr. 29, 2004 (KR) ..... 10-2004-0029923

(51) Int. Cl.
*G09G 3/30* (2006.01)

(52) U.S. Cl. ..... 345/76; 315/169.3; 349/43

(58) Field of Classification Search ..... 345/76, 345/82, 204, 92; 313/499, 500, 498; 315/169.3; 257/59, 72, 347; 438/149, 29; 349/43, 69; 445/24

See application file for complete search history.

(56) References Cited

U.S. PATENT DOCUMENTS 6,965,363 B2 * 11/2005 Sato et al. ..... 345/82
7,068,247 B2 * 6/2006 Nakanishi ..... 345/76
7,239,083 B2 * 7/2007 Koyama ..... 313/506

* cited by examiner

*Primary Examiner*—Abbas I Abdulselam
(74) *Attorney, Agent, or Firm*—Christie, Parker & Hale, LLP

(57) ABSTRACT

A display device including scan lines provided in a first direction for transmitting select signals, data lines provided in a second direction for transmitting data signals, and pixel circuits respectively coupled to the scan lines and the data lines. At least one of the pixel circuits includes a driving transistor for outputting a current corresponding to a data signal, emit elements for outputting light corresponding to the current output by the driving transistor, and emit control transistors coupled between the driving transistor and the emit elements. The display device includes semiconductor layers for forming the emit control transistors and the driving transistor. The semiconductor layers for forming the emit control transistors are formed to be branched from the semiconductor layer for forming the driving transistor and be coupled as a body.

16 Claims, 13 Drawing Sheets

LIGHT EMITTING PANEL AND LIGHT EMITTING DISPLAY

CROSS REFERENCE TO RELATED APPLICATION

This application claims priority to and the benefit of Korean Patent Application No. 10-2004-0029923, filed on Apr. 29, 2004 in the Korean Intellectual Property Office, the entire content of which is incorporated herein by reference.

BACKGROUND OF THE INVENTION

1. Field of the Invention

The present invention relates to a display device, and more particularly, to an organic electroluminescent (EL) display using electroluminescence of organic matter.

2. Discussion of the Related Art

In general, an organic EL display is a displaying device for electrically exciting phosphorous organic compounds to emit light. The organic EL display drives nxm organic light emitting elements arranged in a matrix format to represent images.

The organic light emitting elements have diode characteristics so they may be referred to as organic light emitting diodes (OLEDs), and have a structure including an anode electrode layer (ITO), an organic thin-film layer, and a cathode electrode layer (metallic). The organic thin film has a multi-layered structure including an emitting layer (EML), an electron transport layer (ETL), and a hole transport layer (HTL) to balance electrons and holes and improve light emission efficiency, and additionally has an electron injecting layer (EIL) and a hole injecting layer (HIL). The organic light emitting elements form an organic EL display panel through an arrangement in an nxm matrix format.

Methods for driving the organic EL display panel include a passive matrix method and an active matrix method which uses thin-film transistors (TFTs). The passive matrix method forms anodes and cathodes to cross (or cross over) with or to be substantially perpendicular to each other, and selects lines to drive organic EL elements. The active matrix method sequentially turns on a plurality of TFTs coupled to data lines and scan lines according to scan select signals to thus drive organic EL elements.

A pixel circuit of a general active matrix organic EL display will be described.

FIG. 1 shows one of nxm pixels, that is, equivalently illustrating a pixel provided on the first row and the first column.

As shown in FIG. 1, a pixel 10 has three sub-pixels 10*r*, 10*g*, and 10*b* which have organic EL elements OLEDr, OLEDg, and OLEDb respectively emitting red, green, and blue (RGB) light. In the case of sub-pixels arranged in a stripe pattern, the sub-pixels 10*r*, 10*g*, and 10*b* are coupled to data lines D1*r*, D1*g*, and D1*b*, and a common scan line S1.

The red sub-pixel 10*r* includes transistors M11*r* and M12*r* and a capacitor C1*r* for driving the organic EL element OLEDr. Likewise, the green sub-pixel 10*g* includes transistors M11*g* and M12*g* and a capacitor C1*g*, and the blue sub-pixel 10*b* includes transistors M11*b* and M12*b* and a capacitor C1*b*. The connection and operation of only the sub-pixel 10*r* will now be described since the connections and operations of the sub-pixels 10*r*, 10*g*, and 10*b* are substantially the same.

The driving transistor M11*r* is coupled between a power supply voltage VDD and an anode of the organic EL element OLEDr to transmit a light emitting current to the organic EL element OLEDr, and a cathode of the organic EL element OLEDr is coupled to a voltage of VSS which is lower than the power supply voltage VDD. The current of the driving transistor M11*r* is controlled by a data voltage applied through the transistor M12*r*. In this instance, the capacitor C1*r* is coupled between a source and a gate of the transistor M11*r* to maintain the applied voltage for a predetermined time. A gate of the transistor M12*r* is coupled to the scan line S1 for transmitting an on/off-type select signal, and a source of the transistor M12*r* is coupled to the data line D1*r* for transmitting a data voltage corresponding to the red sub-pixel 10*r*.

In operation, when the switching transistor M12*r* is turned on in response to a select signal applied to the gate, a data voltage of $V_{DATA}$ provided by the data line D1*r* is applied to the gate of the transistor M11*r*. A current ($I_{OLED}$) flows to (and/or through) the transistor M11*r* in correspondence to a voltage charged between the gate and the source by the capacitor C1*r*, and the organic EL element OLEDr emits light in correspondence to the current $I_{OLED}$ In this instance, the current $I_{OLED}$ flowing to the organic EL element OLEDr is given in Equation 1.

$$I_{OLED} = \frac{\beta}{2}(V_{GS} - V_{TH})^2 = \frac{\beta}{2}(V_{DD} - V_{DATA} - |V_{TH}|)^2 \qquad \text{Equation 1}$$

where $V_{TH}$ is a threshold value of the transistor M11*r*, and $\beta$ is a constant.

As represented by Equation 1, in the pixel circuit shown in FIG. 1, a current corresponding to the data voltage is supplied to the organic EL element OLEDr, and the organic EL element OLEDr emits light with a brightness corresponding to the supplied current. In this instance, the applied data voltage has plural values within a predetermined range in order to represent gray scales.

As described, the organic EL display allows one pixel 10 to have three sub-pixels 10*r*, 10*g*, and 10*b*, each of which includes a driving transistor, M11*r*, M11*g* or M11*b*, a switching transistor, M12*r*, M12*g* or M12*b*, and a capacitor, C1*r*, C1*g* or C1*b* for driving an organic EL element. Also, a data line, D1*r*, D1*g* or D1*b*, for transmitting data signals and a power electrode line for transmitting the power supply voltage VDD are provided for each sub-pixel.

Therefore, the number of transistors, capacitors, and wires for transmitting voltages and signals is increased so that it is difficult to lay out all of them in the pixels, and aperture ratios corresponding to light-emitting areas in the pixels are decreased (i.e., a ratio between the bright pixel area and the pixel area that is blocked by the parts to drive each pixel is decreased).

SUMMARY OF THE INVENTION

An aspect of the present invention provides a light emitting display having an efficient arrangement of structures corresponding to pixel areas.

In one exemplary embodiment of the present invention, a display device includes a plurality of scan lines provided in a first direction for transmitting select signals, a plurality of data lines provided in a second direction for transmitting data signals, and a plurality of pixel circuits respectively coupled to the scan lines and the data lines. At least one of the pixel circuits includes a first capacitor, a first transistor, a first emit element, a second emit element, a first emit control transistor, a second emit control transistor, a first emit control line, and a second emit control line. The first capacitor charges a voltage corresponding to one of the data signals. The first transistor outputs a current corresponding to the voltage charged in the first capacitor. The first emit element and the second emit element output light corresponding to the current output by the first transistor. The first emit control transistor is coupled between the first transistor and the first emit element. The second emit control transistor is coupled between the first transistor and the second emit element. The first emit control line is coupled to a control electrode of the first emit control transistor. The second emit control line is coupled to a control electrode of the second emit control transistor. A first semiconductor layer for forming the first emit control transistor and a second semiconductor layer for forming the second emit control transistor are branched from a third semiconductor layer for forming the first transistor, and are formed and coupled to be a body.

The first and second emit control lines may formed to be substantially adjacent and parallel with each other. At least parts of the first and second semiconductor layers may formed to be substantially parallel with each other.

The at least one of the pixel circuits may further comprise a second transistor, a third transistor, and a second capacitor. The second transistor diode-connects the first transistor. The third transistor has a first transistor electrode coupled to a first electrode of the first capacitor, and a second transistor electrode coupled to a second electrode of the first capacitor. The second capacitor has a first capacitor electrode coupled to the second transistor electrode of the third transistor, and a second capacitor electrode coupled to a control electrode of the first transistor.

In exemplary embodiment of the present invention, a display device includes a plurality of scan lines provided in a first direction for transmitting select signals, a plurality of data lines provided in a second direction for transmitting data signals, and a plurality of pixel circuits respectively coupled to the scan lines and the data lines. At least one of the pixel circuit includes a first capacitor, a first transistor, a first emit element, a second emit element, a third emit element, a first emit control transistor, a second emit control transistor, a third emit control transistor, a first emit control line, a second emit control line, and a third emit control line. The first capacitor charges a voltage corresponding to one of the data signals. The first transistor has a control electrode coupled to a first capacitor electrode of the first capacitor, and a first electrode coupled to a second capacitor electrode of the first capacitor, and outputs a current corresponding to the voltage charged in the first capacitor. The first emit element, the second emit element, and the third emit element output light corresponding to the current output by the first transistor. The first emit control transistor is coupled between the first transistor and the first emit element. The second emit control transistor is coupled between the first transistor and the second emit element. The third emit control transistor is coupled between the first transistor and the third emit element. The first emit control line is coupled to a control electrode of the first emit control transistor. The second emit control line is coupled to a control electrode of the second emit control transistor. The third emit control line is coupled to a control electrode of the third emit control transistor. A first semiconductor layer for forming the first emit control transistor, a second semiconductor layer for forming the second emit control transistor, and a third semiconductor layer for forming the third emit control transistor are formed to be branched from a fourth semiconductor layer for forming the first transistor, and be coupled as a body.

At least parts of the first, second, and third semiconductor layers may formed to be substantially parallel with each other so that the first, second, and third semiconductor layers may in a plane have a substantial m shape.

The first transistor may include a p-channel transistor, and the emit control transistors may include p-channel transistors. In addition, the first transistor may include a p-channel transistor, and the emit control transistors may include n-channel transistors.

A junction electrode may be formed at an edge region of the fourth semiconductor layer and the first, second, and third semiconductor layers through a contact hole, and a current output by the first transistor may be transmitted to the emit control transistors through the junction electrode.

In one exemplary embodiment of the present invention, a display panel includes, in an array format, a plurality of scan lines provided in a first direction for transmitting select signals, a plurality of data lines provided in a second direction for transmitting data signals, and a plurality of pixel circuits respectively coupled to the scan lines and the data lines. At least one of the pixel circuits includes a capacitor, a first transistor, a first emit element, a second emit element, a first emit control transistor, a second emit control transistor, a first emit control line, and a second emit control line. The capacitor charges a voltage corresponding to one of the data signals. The first transistor has a control electrode coupled to a first capacitor electrode of the capacitor, and a first electrode coupled to a second capacitor electrode of the capacitor, and outputs a current corresponding to the voltage charged in the capacitor. The first emit element and the second emit element output light corresponding to the current output by the first transistor. The first emit control transistor is coupled between the first transistor and the first emit element. The second emit control transistor is coupled between the first transistor and the second emit element. The first emit control line is coupled to a control electrode of the first emit control transistor and is arranged to be in parallel with the scan line. The second emit control line is coupled to a control electrode of the second emit control transistor and is arranged to be substantially parallel with at least one of the scan lines. A pixel area in which the at least one of pixel circuits is arranged includes a semiconductor layer, a first insulation layer, a metallic layer, and a second insulation layer. The semiconductor layer includes a first semiconductor layer region for forming the first transistor, a second semiconductor layer region for forming the first emit control transistor, and a third semiconductor layer region for forming the second emit control transistor, the second and third semiconductor layer regions being branched from the first semiconductor layer region and being coupled as a body. The first insulation layer is formed on the semiconductor layer. The metallic layer is formed on a portion of the first insulation layer on the second and third semiconductor layer regions, and includes a first metallic layer region for forming the first emit control line and a second metallic layer region for forming the second emit control line. The second insulation layer is formed on the first insulation layer and the metallic layer.

The first and second emit control lines may be arranged to be substantially adjacent and parallel with each other, and at least parts of the second and third semiconductor layer regions may be arranged to be substantially parallel with at least one of the data lines.

Regions other than a channel region of the second and third semiconductor layer regions may doped with p+ impurities. In addition, regions other than a channel region of the second and third semiconductor layer regions may be doped with n+ impurities. A contact hole for penetrating the first and second insulation layers may be formed at the edge of the second and third semiconductor layer regions and the first semiconductor layer region, and a junction electrode may be formed within the contact hole.

In one exemplary embodiment of the present invention, a display panel includes, in an array format, a plurality of scan lines provided in a first direction for transmitting select signals, a plurality of data lines provided in a second direction for transmitting data signals, and a plurality of pixel circuits respectively coupled to the scan lines and the data lines. At least one of the pixel circuits includes a capacitor, a first transistor, a first emit element, a second emit element, a third emit element, a first emit control transistor, a second emit control transistor, a third emit control transistor, a first emit control line, a second emit control line, and a third emit control line. The capacitor charges a voltage corresponding to one of the data signals. The first transistor outputs a current corresponding to the voltage charged in the capacitor. The first emit element, the second emit element, and the third emit element output light of different colors based on the current output by the first transistor. The first emit control transistor is coupled between the first transistor and the first emit element. The second emit control transistor is coupled between the first transistor and the second emit element. The third emit control transistor is coupled between the first transistor and the third emit element. The first emit control line is coupled to a control electrode of the first emit control transistor. The second emit control line is coupled to a control electrode of the second emit control transistor. The third emit control line is coupled to a control electrode of the third emit control transistor. A pixel area in which the at least one of the pixel circuits is arranged comprises a semiconductor layer, a first insulation layer, a metallic layer, and a second insulation layer. The semiconductor layer includes a first semiconductor layer region for forming the first transistor, a second semiconductor layer region for forming the first emit control transistor, a third semiconductor layer region for forming the second emit control transistor, and a fourth semiconductor layer region for forming the third emit control transistor, the second, third, and fourth semiconductor layer regions being branched from the first semiconductor layer region and being coupled as a body. The first insulation layer is formed on the semiconductor layer. The metallic layer is formed on a portion of the first insulation layer on the second, third, and fourth semiconductor layer regions, and includes a first metallic layer region for forming the first emit control line, a second metallic layer region for forming the second emit control line, and a third metallic layer region for forming the third emit control line. The second insulation layer s formed on the first insulation layer and the metallic layer. At least parts of the second, third, and fourth semiconductor layer regions may be arranged to be substantially parallel with at least one of the data lines.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
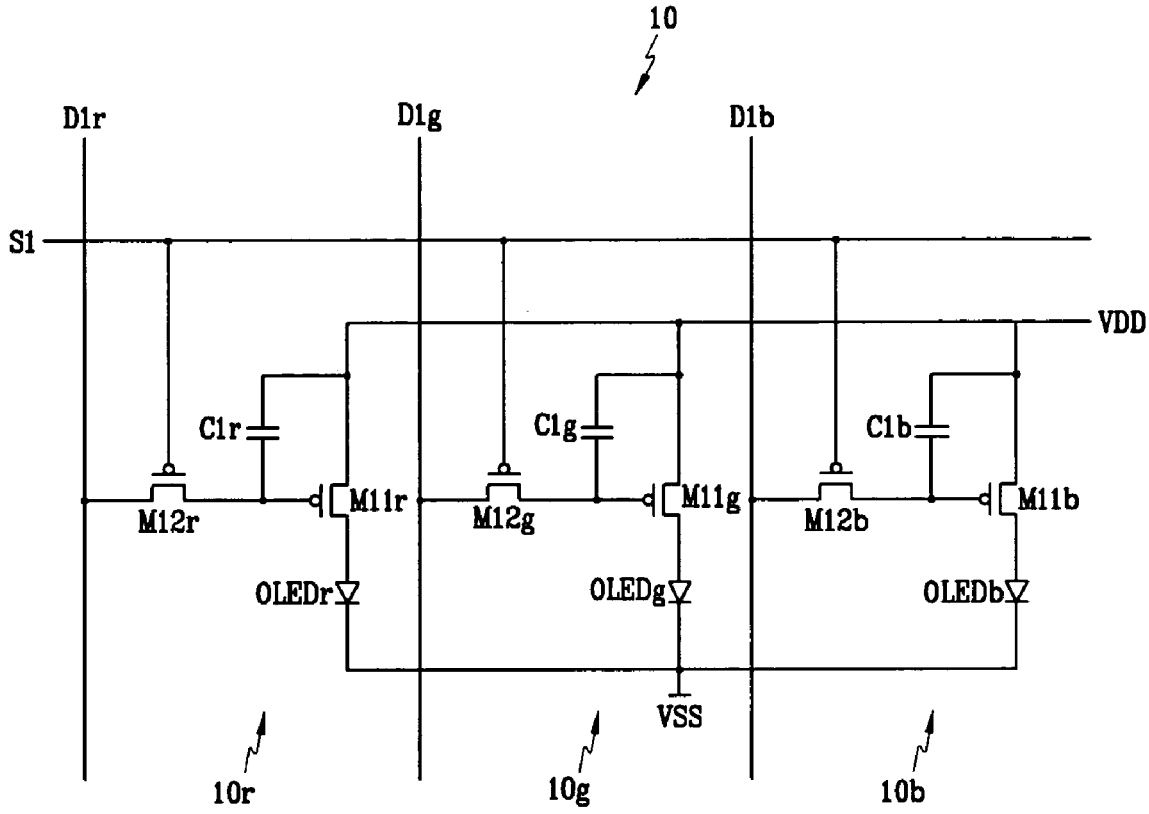
FIG.1 Prior Art
FIG. 1 shows a conventional pixel circuit of a light emitting display panel.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Like reference numerals designate like elements.

As to jargon on the scan lines, a scan line for transmitting a current select signal will be referred to as a "current scan line," a scan line which has transmitted a select signal before the current select signal is transmitted will be referred to as a "previous scan line," and a scan line which will transmit a select signal after the current select signal is transmitted will be referred to as a "subsequent scan line."

In addition, a pixel which emits light based on the select signal of the current scan line will be referred to as a "current pixel," a pixel which emits light based on the select signal of the previous scan line will be referred to as a "previous pixel," and a pixel which emits light based on the select signal of the subsequent scan line will be referred to as a "subsequent pixel."

Exemplary embodiments of the present invention will now be described in detail with reference to the drawings.

Figure 2:
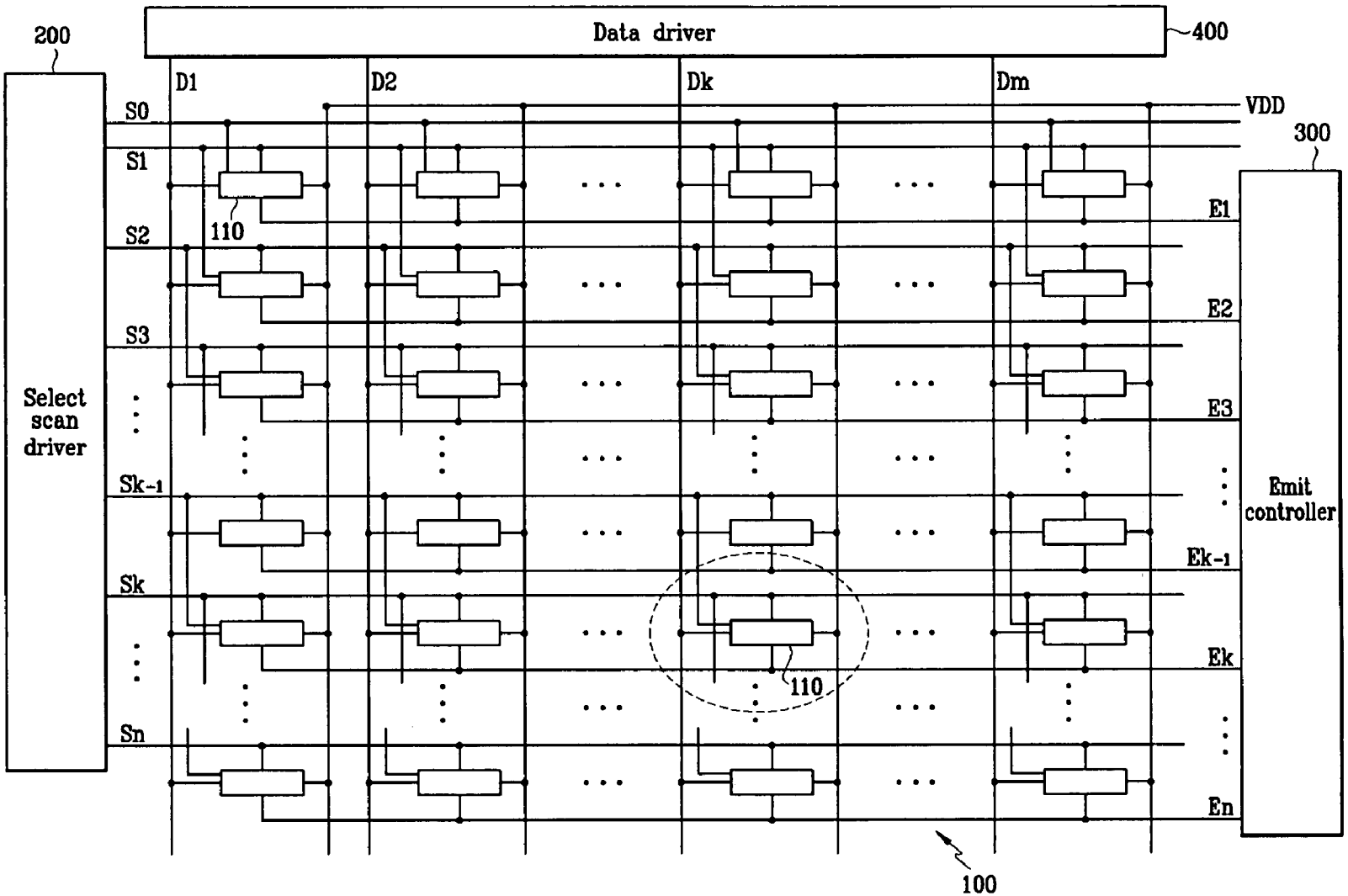
FIG. 2 shows a schematic diagram for an organic EL display according to an exemplary embodiment of the present invention.

FIG. 2 shows a configuration of an organic EL display according to an exemplary embodiment of the present invention.

As shown, the organic EL display includes a display panel 100, a scan driver 200, an emit controller 300, and a data driver 400. The display panel 100 includes a plurality of scan lines S0, S1, . . . , Sk, . . . , Sn and emit control lines E1, . . . , Ek, . . . , En provided in the row direction, a plurality of data lines D1, . . . , Dk, . . . , Dm provided in the column direction, a plurality of power electrode lines for transmitting power supply voltages VDD, and a plurality of pixels 110. A pixel 110 is formed at a pixel area defined or surrounded by two scan lines Sk-1 and Sk and two adjacent data lines Dk-1 and Dk, and is driven by signals transmitted by the current scan line Sk, the previous scan line Sk-1, the emit control line Ek, and the data line Dk. The emit control lines E1 to En respectively include three emit control lines for emitting red, green, and blue (RGB) colors (e.g., E1 includes E1*r*, E1*g*, and E1*b* and En includes Enr, Eng, and Enb).

Figure 3:
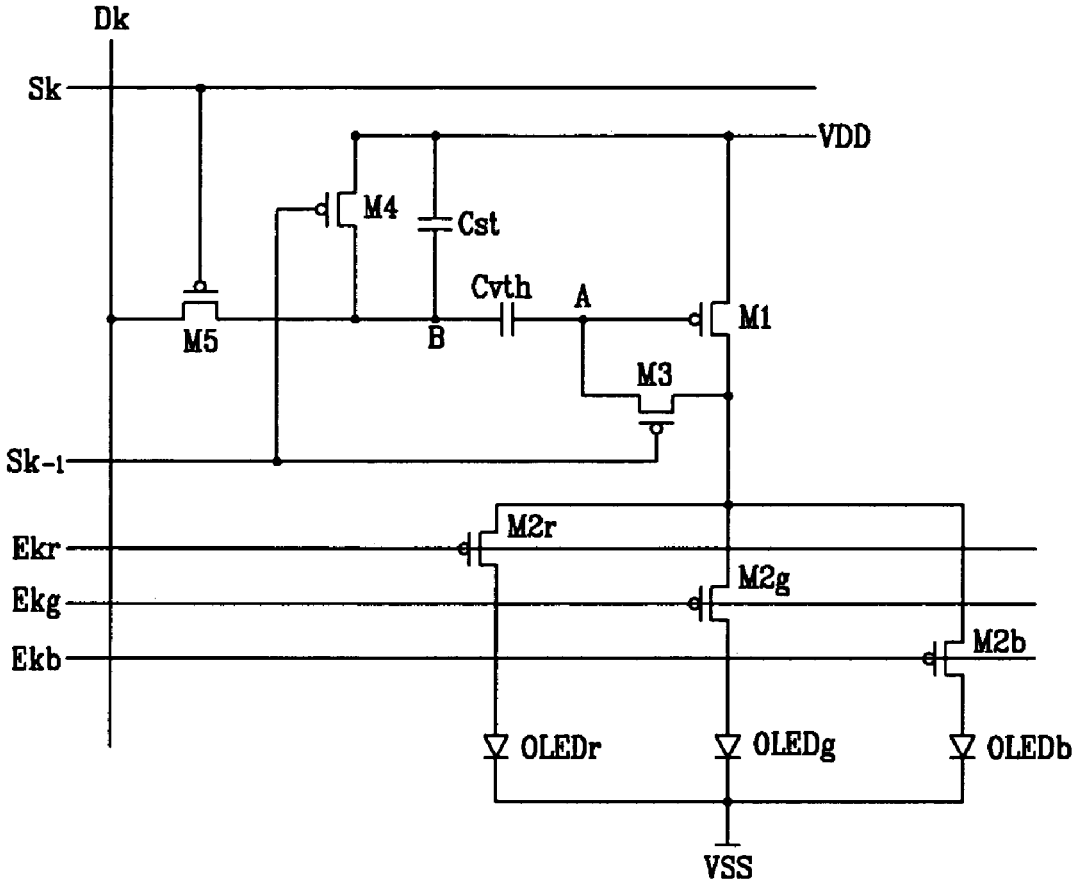
FIG. 3 shows an equivalent circuit diagram of a pixel circuit according to a first exemplary embodiment of the present invention.

The scan driver 200 sequentially transmits select signals for selecting lines to the scan lines S0 to Sn so that data signals may be applied to pixels of the corresponding selected scan lines, the emit controller 300 sequentially transmits emit control signals for controlling emission of the organic EL elements OLEDr, OLEDg, and OLEDb shown in FIG. 3 to the emit control lines E1 to En, and the data driver 400 applies data signals, which correspond to the pixels of the selected scan lines to which the select signals are applied, to the data lines D1 to Dm when the select signals are sequentially applied.

The scan driver 200, the emit controller 300, and the data driver 400 can be coupled to a substrate on which the display panel 100 is provided. Alternatively, the scan driver 200, the emit controller 300, and/or the data driver 400 can be directly installed on a glass substrate of the display panel 100, or can be replaced with a driving circuit formed on the same layer as that of the scan lines, the data lines, and the transistors on the substrate of the display panel 100. Further, the scan driver 200, the emit controller 300, and/or the data driver 400 can be mounted in a chip format on a tape carrier package (TCP) or a flexible printed circuit (FPC) coupled to the substrate of the display panel 100.

In addition, a field can be divided into three subfields which are then driven, and the three subfields program red, green, and blue data and emit light. To achieve this purpose, the scan driver 200 sequentially transmits a select signal to the scan lines S0 to Sn for each subfield, the emit controller 300 applies an emit control signal to the emit control lines E1 to En so that the organic EL elements of respective colors may emit light in a subfield, and the data driver 400 applies data signals corresponding to the red, green, and blue organic EL elements to the data lines D1 to Dm in the three subfields.

An operation of the organic EL display of FIG. 2 according to a first exemplary embodiment of the present invention will be described in detail with reference to FIG. 3.

FIG. 3 shows an equivalent circuit diagram of the pixel 110 in the organic EL display shown in FIG. 2. For ease of description, the pixel Pk coupled to the scan line Sk of the k-th row and the data line Dk of the k-th column is exemplarily illustrated, and p-channel transistors are shown by way of example in FIG. 3.

As shown in FIG. 3, the pixel circuit includes a driving transistor M1, a diode transistor M3, a capacitor transistor M4, a switching transistor M5, organic EL elements OLEDr, OLEDg, and OLEDb, emit control transistors M2*r*, M2*g*, and M2*b* for controlling emission of the organic EL elements OLEDr, OLEDg, and OLEDb, and capacitors Cst and Cvth. One emit control line Ek shown in FIG. 2 includes emit control lines Ekr, Ekg, and Ekb. The emit control transistors M2*r*, M2*g*, and M2*b* respond to emit control signals transmitted by the emit control lines Ekr, Ekg, and Ekb, and selectively transmit the current provided by the driving transistor M1 to the organic EL elements OLEDr, OLEDg, and OLEDb.

In detail, the transistor M5 has a gate coupled to the current scan line Sk and a source coupled to the data line Dk, and the transistor M5 responds to the select signal provided by the scan line Sk and transmits the data voltage provided by the data line Dk to a node B of the capacitor Cvth. The transistor M4 responds to the select signal provided by the previous scan line Sk-1 and couples the node B of the capacitor Cvth to the power supply voltage VDD. The transistor M3 is coupled to a node A of the capacitor Cvth and is also coupled to the organic EL elements OLEDr, OLEDg, and OLEDb through the transistors M2*r*, M2*g*, and M2*b*, respectively. The transistor M3 responds to the select signal provided by the previous scan line Sk-1 and diode-connects the transistor M1. The driving transistor M1 for driving the organic EL element OLED has a gate coupled to the node A of the capacitor Cvth and a source coupled to the power supply voltage VDD, and controls the current to be applied to the organic EL element OLED (e.g., OLEDr, OLEDg, and/or OLEDb) according to the voltage applied to the gate.

Also, the capacitor Cst has a first electrode coupled to the power supply voltage VDD and a second electrode coupled to a drain electrode of the transistor M4 (e.g., at around the node B), and a first electrode or node B of the capacitor Cvth is coupled to the second electrode of the capacitor Cst to thus couple the two capacitors in series, and a second electrode or node A of the capacitor Cvth is coupled to the gate electrode of the driving transistor M1 (e.g., at around the node A).

The drain of the driving transistor M1 is coupled to sources of the emit control transistors M2*r*, M2*g*, and M2*b* which have gates respectively coupled to the emit control lines Ekr, Ekg, and Ekb. The emit control transistors M2*r*, M2*g*, and M2*b* have drains respectively coupled to anodes of the organic EL elements OLEDr, OLEDg, and OLEDb which have cathodes to which the power supply voltage VSS of less than the power supply voltage VDD is applied. A negative voltage or a ground voltage can be used for the power supply voltage VSS.

In operation, when a low-level scan voltage is applied to the previous scan line Sk-1, the transistors M3 and M4 are turned on. When the transistor M3 is turned on the transistor M1 is diode-connected. Therefore, a voltage difference between the gate and the source of the transistor M1 is varied until the voltage difference reaches a threshold voltage (Vth) of the transistor M1. Since the source of the transistor M1 is coupled to the power supply voltage VDD in this instance, the voltage applied to the gate of the transistor M1, that is, the node A of the capacitor Cvth, becomes a sum of the power supply voltage VDD and the threshold voltage (Vth). Further, the transistor M4 is turned on to apply the power supply voltage VDD to the node B of the capacitor Cvth. As such, a voltage (Vcvth) charged in the capacitor Cvth is given in Equation 2.

$$V_{Cvth}=V_{CvthA}-V_{CvthB}=(VDD+V_{th})-VDD=V_{th} \quad \text{Equation 2}$$

where $V_{Cvth}$ is a voltage charged in the capacitor Cvth, $V_{CvthA}$ is a voltage applied to the node A of the capacitor Cvth, and $V_{CvthB}$ is a voltage applied to the node B of the capacitor Cvth.

When a low-level scan voltage is applied to the current scan line Sk, the transistor M5 is turned on to apply the data voltage (Vdata) to the node B. Also, since the capacitor Cvth is charged with the voltage corresponding to the threshold voltage (Vth) at the transistor M1, the voltage corresponding to the sum of the data voltage (Vdata) and the threshold voltage (Vth) at the transistor M1 is applied to the gate of the transistor M1. That is, a voltage (Vgs) between the gate and the source of the transistor M1 is given in Equation 3. In this instance, a high-level signal is applied to the emit control line Ek (e.g., Ekr, Ekg, and/or Ekb), and the transistor M2 (e.g., M2*r*, M2*g*, and/or M2*b*) is turned off to block a current flow.

$$V_{gs}=(V_{data}+V_{th})-VDD \quad \text{Equation 3}$$

Next, the transistor M2 is turned on in response to a low level of the emit control line Ek, the current ($I_{OLED}$) corresponding to the gate-source voltage of Vgs at the transistor M1 is supplied to the organic EL element OLED through the transistor M2, and the organic EL element OLED (e.g., OLEDr, OLEDg, and/or OLEDb) emits light. The current ($I_{OLED}$) is given in Equation 4.

$$I_{OLED} = \frac{\beta}{2}(V_{gs} - V_{th})^2 = \frac{\beta}{2}((V_{data} + V_{th} - VDD) - V_{th})^2 = \frac{\beta}{2}(VDD - V_{data})^2 \quad \text{Equation 4}$$

where $I_{OLED}$ is a current flowing to the organic EL element, $V_{gs}$ is a voltage between the source and the gate of the transistor M1, $V_{th}$ is a threshold voltage of the transistor M1, $V_{data}$ is a data voltage, and β is a constant.

In more detail, when the emit control transistor M2*r* is turned on in response to the low-level emit control signal provided by the emit control line Ekr, in the case that the data voltage (Vdata) represents a red data signal, the current ($I_{OLED}$) is transmitted to the red organic EL element OLEDr which then emits light.

Likewise, when the emit control transistor M2*g* is turned on in response to the low-level emit control signal provided by the emit control line Ekg, in the case that the data voltage (Vdata) represents a green data signal, the current ($I_{OLED}$) is transmitted to the green organic EL element OLEDg, which then emits light. Also, when the emit control transistor M2*b* is turned on in response to the low-level emit control signal provided by the emit control line Ekb, in the case that the data voltage (Vdata) represents a blue data signal, the current ($I_{OLED}$) is transmitted to the blue organic EL element OLEDb which then emits light. The three light control signals applied to the three emit control lines Ekr, Ekg, and Ekg respectively have a low-level period which is not superimposed on one another so that one pixel may represent red, green, and blue.

Referring to FIGS. 4 to 8, an arrangement structure of a pixel area in which a pixel circuit is provided in the organic EL display according to the first exemplary embodiment of the present invention will be described. Herein, certain components of the current pixel Pk will have normal reference numerals, and certain components of the previous pixel Pk-1 will have apostrophe-added ("') reference numerals to thus distinguish the certain components of the current pixel from the certain components of the previous pixel.

Figure 4:
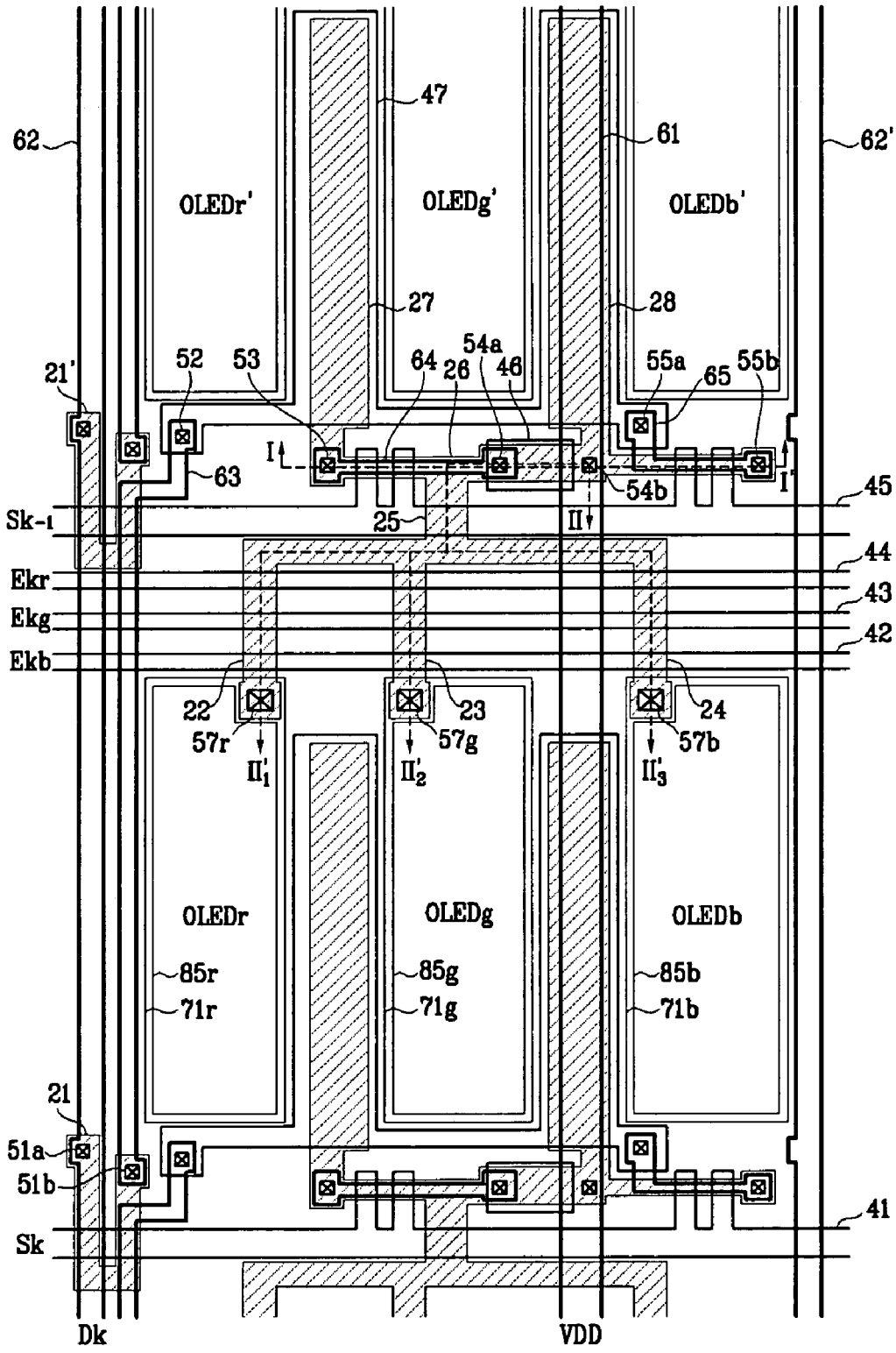
FIG. 4 shows an arrangement diagram for the pixel circuit according to the first exemplary embodiment of the present invention.
Figure 5:
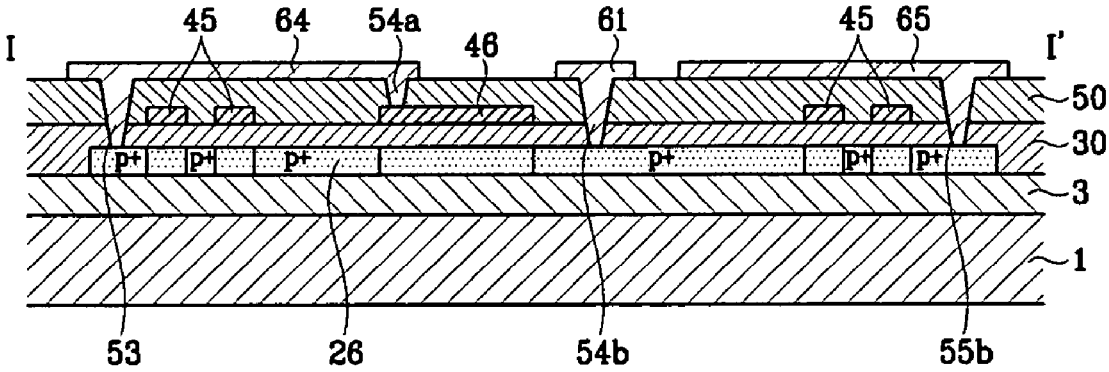
FIG. 5 shows a cross-sectional view with respect to the part of I to I' in FIG. 4.
Figure 6:
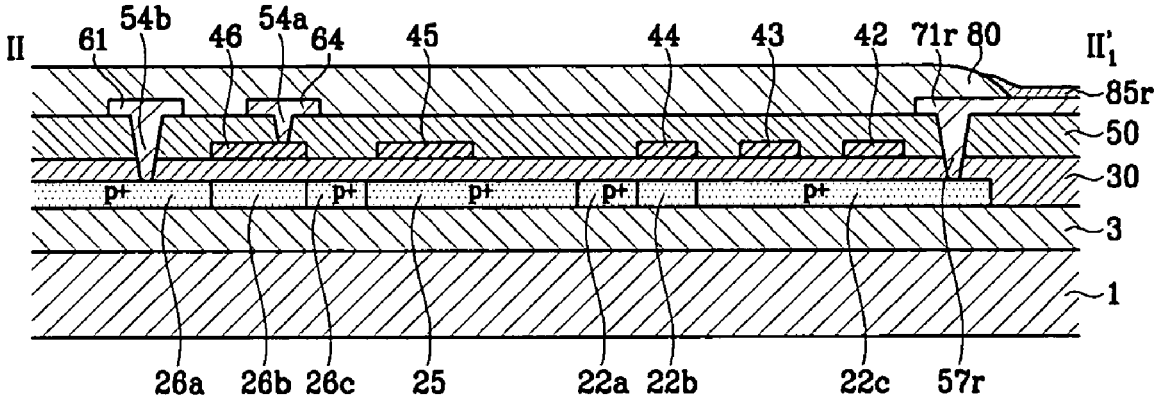
FIG. 6 shows a cross-sectional view with respect to the part of II to II1' in FIG. 4.
Figure 7:
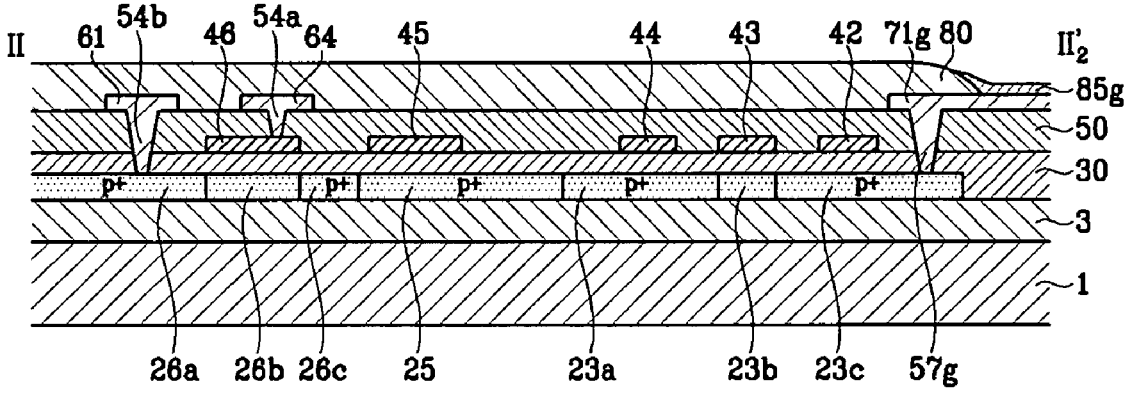
FIG. 7 shows a cross-sectional view with respect to the part of II to II2' in FIG. 4.
Figure 8:
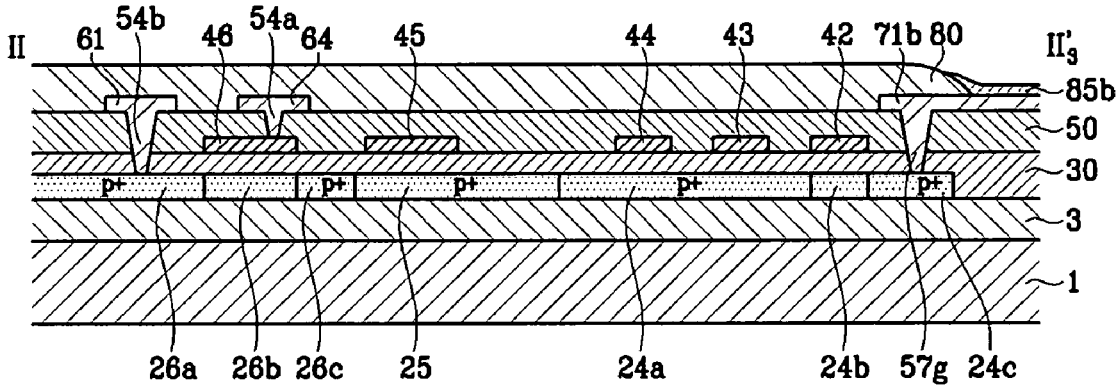
FIG. 8 shows a cross-sectional view with respect to the part of II to II3' in FIG. 4.
Figure 9:
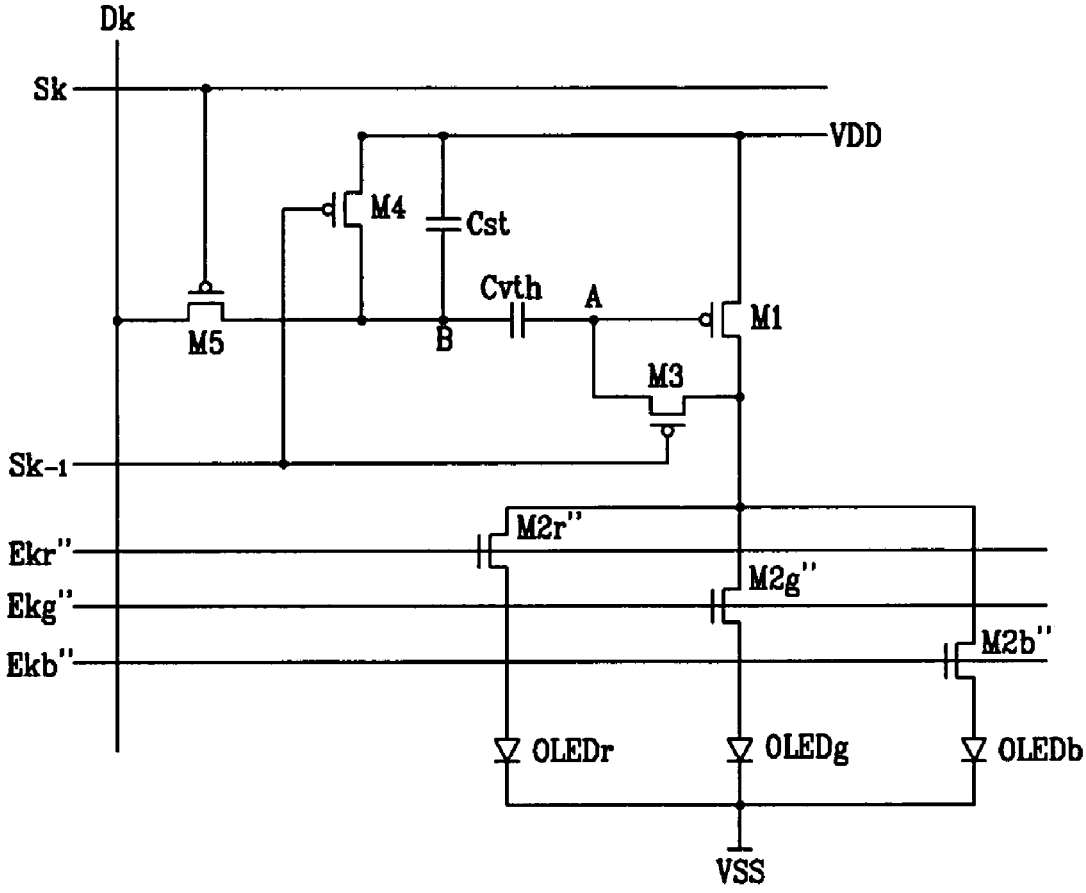
FIG. 9 shows an equivalent circuit diagram of a pixel circuit according to a second exemplary embodiment of the present invention.
Figure 10:
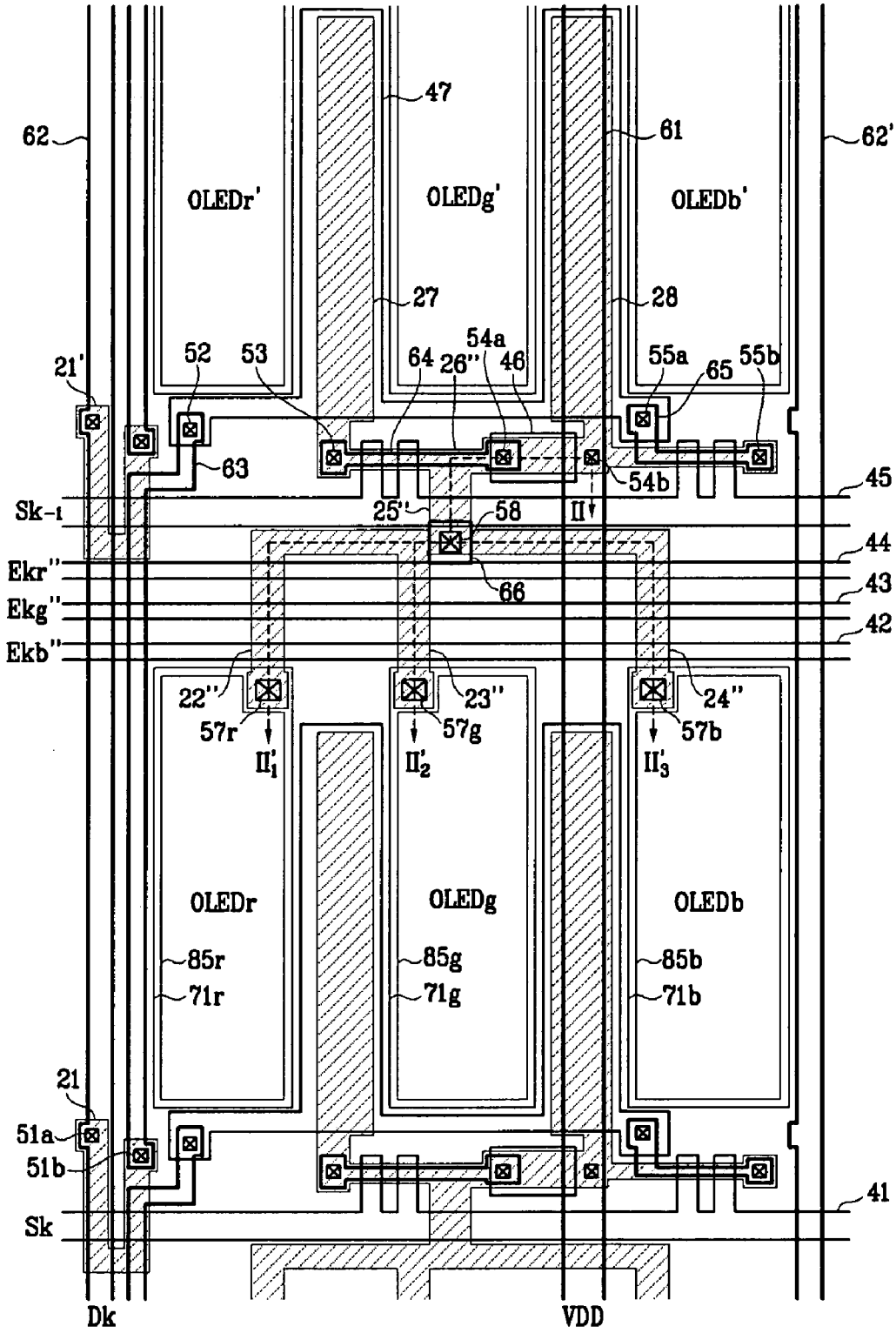
FIG. 10 shows an arrangement diagram for the pixel area according to the second exemplary embodiment of the present invention.

FIG. 4 shows an exemplified arrangement diagram for a pixel area in which the pixel circuit shown in FIG. 3 is arranged according to the first exemplary embodiment of the present invention, FIG. 5 shows a cross-sectional view with respect to the part of I to I' in FIG. 4, FIG. 6 shows a cross-sectional view with respect to the part of II to II1' in FIG. 4, FIG. 7 shows a cross-sectional view with respect to the part of II to II2' in FIG. 4, and FIG. 8 shows a cross-sectional view with respect to the part of II to II3' in FIG. 4.

As shown by FIGS. 4 and 5, a shield layer 3 of silicon oxide is formed on an insulation substrate 1, and polysilicon layers 21, 22, 23, 24, 25, 26, 27, and 28, which are semiconductor layers are formed on the shield layer 3.

The U-shaped polysilicon layer 21 forms a semiconductor layer including a source region, a drain region, and a channel region of the transistor M5 of the current pixel Pk. The polysilicon layers 22, 23, 24, 25, 26, 27, and 28 are formed in a body or as a single unit. The polysilicon layer 27 is extended in the column direction between the emit elements OLEDr' and OLEDg' of the previous pixel Pk-1 to form the node A of FIG. 3, which is an electrode or a first electrode of the capacitor Cvth. The polysilicon layer 28 is extended in a column direction between the emit elements OLEDg' and OLEDb' of the previous pixel Pk-1 to form an electrode of the capacitor Cst. The polysilicon layer 26 is adjacent to the emit elements OLEDg' and OLEDb' and is extended in a row direction with the horizontal width of the emit elements OLEDg' and OLEDb' to form a semiconductor layer of the transistors M1, M3, and M4. The polysilicon layer 25 is coupled to the polysilicon layer 26 on about the center of the row-directional width of a pixel area, that is, on about the center of the horizontal width of the emit elements OLEDr', OLEDg', and OLEDb'. The polysilicon layer 25 is formed in the column direction, and forms a drain region of the transistor M1 and source regions of the transistors M2*r*, M2*g*, and M2*b*. The polysilicon layers 22, 23, and 24 are branched out from the polysilicon layer 25 to form an 'm' pattern and form drain regions of the transistors M2*r*, M2*g*, and M2*b*.

A gate insulation film 30 is formed on the above-formed polysilicon layers 21, 22, 23, 24, 25, 26, 27, and 28.

Gate electrode lines 41, 42, 43, 44, 45, 46, and 47 are formed on the gate insulation film 30. In more detail, since the gate electrode line 41 is extended in the row direction and corresponds to the current scan line Sk of the current pixel Pk, the gate electrode line 41 insulatively crosses the polysilicon layer 21 and forms a gate electrode of the transistor M5 of the is current pixel Pk. Since the gate electrode line 42 is extended in the row direction and corresponds to the emit control line Ekb of the current pixel Pk, the gate electrode line 42 forms a gate electrode of the transistor M2*b*. Since the gate electrode line 43 is extended in the row direction and corresponds to the emit control line Ekg of the current pixel Pk, the gate electrode line 43 forms a gate electrode of the transistor M2*g*. Since the gate electrode line 44 is extended in the row direction and corresponds to the emit control line Ekr of the current pixel Pk, the gate electrode line 44 forms a gate electrode of the transistor M2*k*. Since the gate electrode line 45 is extended in the row direction and corresponds to the previous scan line Sk-1 of the previous pixel Pk-1, the gate electrode line 45 insulatively crosses the polysilicon layer 21' and forms a gate electrode of the transistor M5 of the previous pixel Pk-1. Also, the gate electrode line 45 insulatively crosses the polysilicon layer 25 and forms gate electrodes of the transistors M3 and M4 of the current pixel Pk. The gate electrode 46 insulatively crosses the polysilicon layer 26 in a rectangular manner on the bottom of the emit element OLEDg' to form a gate electrode of the transistor M1. The gate electrode 47 is formed in a U shape and is provided between the emit elements OLEDr' and the OLEDg' and between the emit elements OLEDg' and the OLEDb', and forms a node B on which the capacitors Cvth and Cst are coupled in series. Therefore, as shown in FIG. 6, a portion of the gate electrode 47 is superimposed on the polysilicon layer 27 to become an electrode of the capacitor Cvth, and another portion of the gate electrode 47 is superimposed on the polysilicon layer 28 to become an electrode of the capacitor Cst.

Referring now back to FIGS. 4 and 5, an inter-layer insulation film 50 is formed on the gate electrodes 41, 42, 43, 44, 45, 46, and 47. A power electrode line 61, a data line 62, and electrodes 63, 64, 65, 71*r*, 71*g*, and 71*b* are formed on the inter-layer insulation film 50 and are coupled to the corresponding electrodes through contact holes 51*a*, 51*b*, 52, 53, 54*a*, 55*a*, 55*b*, 57*r*, 57*g*, and 57*b*.

The power electrode line 61 is extended in the column direction between the emit elements OLEDg and OLEDb, and is coupled to the polysilicon layers 28 and 26 through a contact hole 54*b*, which penetrates the inter-layer insulation film 50 and the gate insulation film 30, to supply power to the first electrode of the capacitor Cst and the source of the transistor M1.

The data line 62 is extended in the column direction between a pixel area and another pixel area, and is coupled to the polysilicon layer 21 through a contact hole 51*a*, which penetrates the inter-layer insulation film 50 and the gate insulation film 30, and is coupled to the source of the transistor M4.

The electrode 63 couples the polysilicon layer 21 and the gate electrode 47 through the contact hole 51*b*, which penetrates the inter-layer insulation film 50 and the gate insulation film 30, and a contact hole 52, which penetrates the inter-layer insulation film 50, and becomes the node B of FIG. 3.

The electrode 64 couples the drain of the transistor M3 of the polysilicon layer 26 and the gate electrode 46 through the contact hole 53, which penetrates the inter-layer insulation film 50 and the gate insulation film 30, and the contact hole 54*a*, which penetrates the inter-layer insulation film 50, and becomes the node A of FIG. 3.

The electrode 65 couples the drain of the transistor M4 of the polysilicon layer 25 and the gate electrode 47 through the contact hole 55*a*, which penetrates the inter-layer insulation film 50, and the contact hole 55*b*, which penetrates the inter-layer insulation film 50 and the gate insulation film 30, and becomes the node B.

The electrodes 71*r*, 71*g*, and 71*b* are pixel electrodes of the respective emit elements. The pixel electrodes 71*r*, 71*g*, and 71*b* are respectively coupled to the polysilicon layers 22, 23, and 24 through the contact holes 57*r*, 57*g*, and 57*b*, which penetrate the gate insulation film 30 and the inter-layer insulation film 50, and are then coupled respectively to the drain electrodes of the transistors M2*r*, M2*g*, and M2*b*.

The pixel electrodes 71*r*, 71*g*, and 71*b* of emit elements OLEDr, OLEDg, and OLEDb are formed to have a substantially rectangular shape in which the vertical liner or side of the rectangle parallel to the data line 62 is longer than the horizontal line or side of the rectangle parallel to the gate electrodes 42 to 44, and hence, the longer vertical lines of the emit elements OLEDr, OLEDg, and OLEDb are arranged near each other. Multi-layered organic thin-films 85*r*, 85*g*, and 85*b* are formed on the pixel electrodes 71*r*, 71*g*, and 71*b*.

Referring to FIGS. 6 to 8, an arrangement structure of the emit control transistors M2*r*, M2*g*, and M2*b* will be described in more detail. The emit control transistors M2*r*, M2*g*, and M2*b* are turned on in response to emit control signals transmitted through the emit control lines Ekr, Ekg, and Ekb, and transmit the current ($I_{OLED}$) applied by the drain of the transistor M1 to the pixel electrodes 71*r*, 71*g*, and 71*b* of the emit elements OLEDr, OLEDg, and OLEDb. FIGS. 6 to 8 illustrate partial cross-sectional views of the source region of the driving transistor M1 coupled to the power electrode line 61 through the contact hole 54*b* and the pixel electrodes 71*r*, 71*g*, and 71*b* coupled to the source regions of the emit control transistors M2*r*, M2*g*, and M2*b* through the contact holes 57*r*, 57*g*, and 57*b*.

As described above, the polysilicon layer 26 for forming the p-channel driving transistor M1 and the polysilicon layers 22, 23, 24, and 25 for respectively forming p-channel emit control transistors M2*r*, M2*g*, and M2*b* are formed in a body.

Therefore, the polysilicon layers 22, 23, 24, 25, and 26 for forming the p-channel transistors M1, M2*r*, M2*g*, and M2*b* are formed in a body on the shield layer 3. Referring to FIG. 6, the source region 26*a* and the drain region 26*c* of the transistor M1 are doped with p+impurities, and the channel region 26*b* of the transistor M1 is provided as an intrinsic polysilicon layer. Also, the source regions 25 and 22*a* and the drain region 22*c* of the transistor M2*r* are doped with p+impurities, and the channel region 22*b* of the transistor M2*r* is provided as an intrinsic polysilicon layer. Therefore, the current ($I_{OLED}$) generated by the voltage difference between the gate 46 of the transistor M1 and the source region 26*a* coupled to the power electrode line based on Equations 3 and 4 is transmitted to the drain region 22*c* of the transistor M2*r* from the drain region 26*c* of the transistor M1 through the source regions 25 and 22*a* and the channel region 22*b* of the transistor M2*r* when an On signal is transmitted to the emit control line Ekr and a channel is generated in the channel region 22*b* of the transistor M2*r*. Also, the current ($I_{OLED}$) is transmitted to the pixel electrode 71*r* coupled to the drain region 22*c* through the contact hole 57*r* to thus emit the red organic EL element OLEDr.

Referring to FIG. 7, the source region 26*a* and the drain region 26*c* of the transistor M1 are doped with p+impurities, and the channel region 26*b* of the transistor M1 is provided as an intrinsic polysilicon layer. Also, the source regions 25 and 23*a* and the drain region 23*c* of the transistor M2*g* responding to a signal transmitted by the emit control line Ekg are doped with p+ impurities, and the channel region 23*b* of the transistor M2*g* is provided as an intrinsic polysilicon layer. Therefore, the current ($I_{OLED}$) generated by the voltage difference between the gate 46 of the transistor M1 and the source region 26*a* coupled to the power electrode line based on Equations 3 and 4 is transmitted to the drain region 23*c* of the transistor M2*g* from the drain region 26*c* of the transistor M1 through the source regions 25 and 23*a* and the channel region 23*b* of the transistor M2*g* when an On signal is transmitted to the emit control line Ekg and a channel is generated in the channel region 23*b* of the transistor M2*g*. Also, the current ($I_{OLED}$) is transmitted to the pixel electrode 71*g* coupled to the drain region 23*c* through the contact hole 57*g* to thus emit the green organic EL element OLEDg.

Referring to FIG. 8, the source regions 25 and 24*a* and the drain region 24*c* of the transistor M2*b* responding to a signal transmitted by the emit control line Ekb are doped with p+impurities, and the channel region 24*b* of the transistor M2*b* is provided as an intrinsic polysilicon layer. Therefore, the current ($I_{OLED}$) generated by the voltage difference between the gate 46 of the transistor M1 and the source region 26*a* coupled to the power electrode line based on Equations 3 and 4 is transmitted to the drain region 24*c* of the transistor M2*b* from the drain region 26*c* of the transistor M1 through the source regions 25 and 24*a* and the channel region 24*b* of the transistor M2*b* when an On signal is transmitted to the emit control line Ekb and a channel is generated in the channel region 24*b* of the transistor M2*b*. Also, the current ($I_{OLED}$) is transmitted to the pixel electrode 71*b* coupled to the drain region 24*c* through the contact hole 57*b* to thus emit the blue organic EL element OLEDb.

Accordingly, when a pixel area includes a plurality of organic EL elements, and a plurality of emit control transistors are provided between the drain electrode of the driving transistor and the organic EL elements, the respective elements can be effectively arranged in the pixel area without reduction of aperture ratio by making the polysilicon layers of the driving transistor and the emit control transistors into a body as described in the first exemplary embodiment.

Referring to FIGS. 9 to 13, a second exemplary embodiment of the present invention will be described.

Differing from the first embodiment, the second embodiment uses n-channel transistors M2*r*", M2*g*", and M2*b*". Hence, the emit control signals Ekr", Ekg", and Ekb" of the second embodiment are inverted signals of the emit control signals Ekr, Ekg, and Ekb of the first embodiment. Also, differing from FIG. 4, a contact hole 58 and an electrode are formed between the polysilicon layer 25" (combined into a body with the polysilicon layer 26") and the polysilicon layers 22", 23", and 24".

Figure 11:
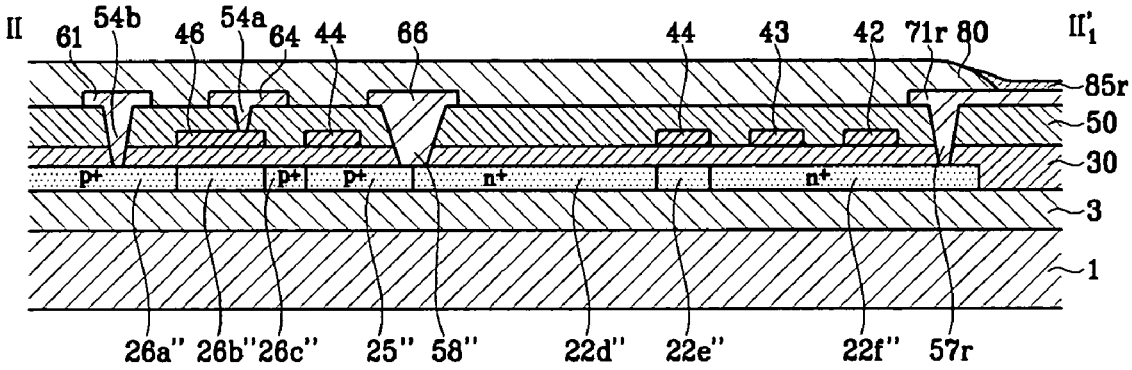
FIG. 11 shows a cross-sectional view with respect to the part of II to II1' in FIG. 10.
Figure 12:
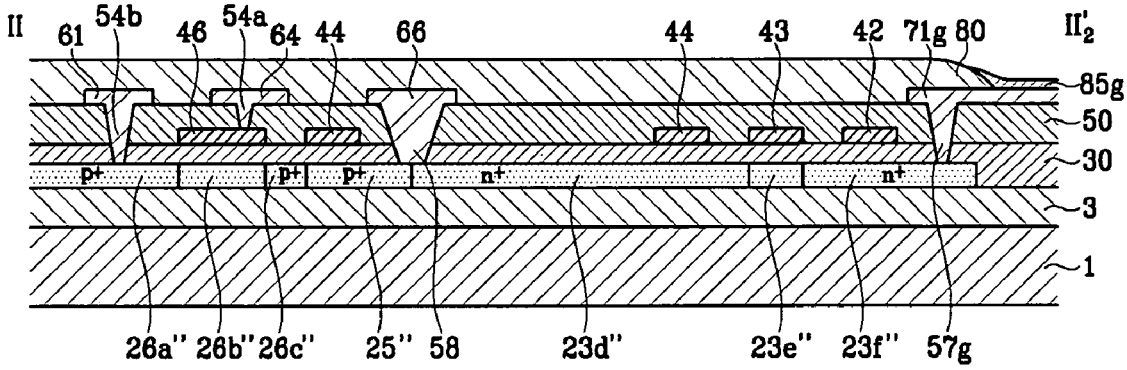
FIG. 12 shows a cross-sectional view with respect to the part of II to II2' in FIG. 10.
Figure 13:
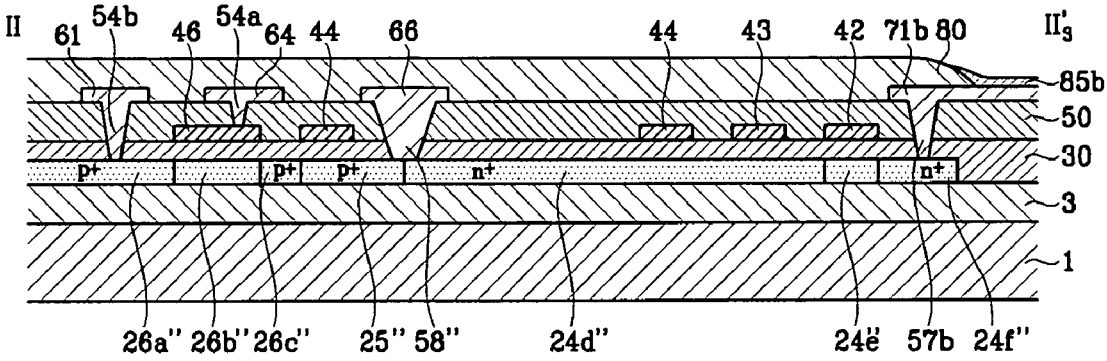
FIG. 13 shows a cross-sectional view with respect to the part of II to II3' in FIG. 10.

In more detail and referring to FIGS. 11 to 13, since the driving transistor M1 is a p-channel transistor and the emit control transistors M2*r*", M2*g*", and M2*b*" are n-channel transistors, the polysilicon layers of the drain regions 26*c*" and 25" of the driving transistor M1 are doped with p+ impurities, and the polysilicon layers of the source regions 22*d*", 23*d*" and 24*d*" of the emit control transistor M2*r*", M2*g*", and M2*b*" are doped with n+ impurities. Therefore, the current ($I_{OLED}$) is transmitted to the source regions 22*d*", 23*d*", and 24*d*" of the emit control transistors M2*r*", M2*g*", and M2*b*" through the electrode 66 in the drain region of the driving transistor M1 by forming the electrode 66 on the edges of the p+ polysilicon layer 25" and the n+ polysilicon layers 22*d*", 23*d*", and 24*d*" through the contact hole 58.

In detail, referring to FIG. 11, the polysilicon layers for forming the p-channel transistor M1 and the n-channel transistors M2*r*", M2*g*", and M2*b*" are formed as a body on the shield layer 3. The source region 26*a*" and the drain regions 26*c*" and 25" of the transistor M1 are doped with p+impurities, and the channel region 26*b*" of the transistor M1 is provided as an intrinsic polysilicon layer. Also, the source region 22*d*" and the drain region 22*f*" of the transistor M2*r*" responding to a signal transmitted by the emit control line Ekr" are doped with n+impurities, and the channel region 22*e*" of the transistor M2*r*" is provided as an intrinsic polysilicon layer. Also, a contact hole 58 is formed on the edge of the polysilicon layer 25" doped with p+ impurities and the source region 22*d*" of the transistor M2*r*", and the electrode 66 is formed on the contact hole 58. Therefore, the current ($I_{OLED}$) generated by the voltage difference between the gate 46 of the transistor M1 and the source region 26*a*" coupled to the power electrode line 61 based on Equations 3 and 4 is transmitted to the drain region 22*f*" of the transistor M2*r*" from the drain regions 26*c*" and 25" of the transistor M1 through the electrode 66 and the source region 22*d*" and the channel region 22*e*" of the transistor M2*r*" when an On signal is transmitted to the emit control line Ekr" and a channel is generated in the channel region 22*e*" of the transistor M2*r*". Also, the current ($I_{OLED}$) is transmitted to the pixel electrode 71*r* coupled to the drain region 22*f*" through the contact hole 57*r* to thus emit the red organic EL element OLEDr.

Referring to FIG. 12, the source region 23*d*" and the drain region 23*f*" of the transistor M2*g*" responding to a signal transmitted by the emit control line Ekg" are doped with n+impurities, and the channel region 23*e*" of the transistor M2*g*" is provided as an intrinsic polysilicon layer. Therefore, the current ($I_{OLED}$) generated by the transistor M1 is transmitted to the drain region 23*f*" of the transistor M2*g*" from the drain regions 26*c*" and 25" of the transistor M1 through the electrode 66 and the source region 23*d*" and the channel region 23*e*" of the transistor M2*g*" when an On signal is transmitted to the emit control line Ekg" and a channel is generated in the channel region 23*e*" of the transistor M2*g*". Also, the current ($I_{OLED}$) is transmitted to the pixel electrode 71 g coupled to the drain region 23*f*" through the contact hole 57*g* to thus emit the green organic EL element OLEDg.

Referring to FIG. 13, the source region 24*d*" and the drain region 24*f*" of the transistor M2*b*" responding to a signal transmitted by the emit control line Ekb" are doped with n+ impurities, and the channel region 24*e*" of the transistor M2*b*" is provided as an intrinsic polysilicon layer. Therefore, the current ($I_{OLED}$) generated by the transistor M1 is transmitted to the drain region 24*f*" of the transistor M2*b*" from the drain regions 26*c*" and 25" of the transistor M1 through the electrode 66 and the source region 24*d*" and the channel region 24*e*" of the transistor M2*b*" when an On signal is transmitted to the emit control line Ekb" and a channel is generated in the channel region 24*e*" of the transistor M2*b*". Also, the current ($I_{OLED}$) is transmitted to the pixel electrode 71*b* coupled to the drain region 24*f*" through the contact hole 57*b* to thus emit the blue organic EL element OLEDb.

Accordingly, the p-channel driving transistor M1 and the n-channel emit control transistors M2*r*", M2*g*", and M2*b*" are efficiently arranged in the relatively small area.

The described exemplary embodiments describe the pixel circuit which includes five transistors, two capacitors, and three emit elements. However, the number of emit elements are not restricted to three. By way of example, the principles of the present invention are also applicable to a pixel circuit including two or four emit elements, and they are also applicable to the pixel circuit with two transistors and one capacitor shown in FIG. 1.

According to certain embodiments of the present invention, by making the polysilicon layers of the p-channel driving transistor and the p-channel emit control transistors into a body without additional wiring, the respective elements which configure the pixel can be arranged in the pixel area more effectively without reducing the aperture ratios of the organic EL elements.

Further, according to certain embodiments of the present invention when using the p-channel driving transistor and the n-channel emit control transistors, the polysilicon layers are made into a body, and a contact hole and a wire are formed between the drain region of the p+ driving transistor and the source region of the n+ emit control transistor. As such, in these certain embodiments of the present invention, the driving transistor and the emit control transistors are more easily arranged in the small area without reduction of the aperture ratios of the organic EL elements.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A display device including a plurality of scan lines provided in a first direction for transmitting select signals, a plurality of data lines provided in a second direction for transmitting data signals, and a plurality of pixel circuits respectively coupled to the scan lines and the data lines, wherein at least one of the pixel circuits comprises:

a first capacitor for charging a voltage corresponding to one of the data signals;

a first transistor for outputting a current corresponding to the voltage charged in the first capacitor;

a first emit element and a second emit element for outputting light corresponding to the current output by the first transistor;

a first emit control transistor coupled between the first transistor and the first emit element;

a second emit control transistor coupled between the first transistor and the second emit element;

a first emit control line coupled to a control electrode of the first emit control transistor; and a second emit control line coupled to a control electrode of the second emit control transistor, wherein a first semiconductor layer for forming the first emit control transistor and a second semiconductor layer for forming the second emit control transistor are branched from a third semiconductor layer for forming the first transistor and are formed as a single body with the third semiconductor layer.

2. The display device of claim 1, wherein the first and second emit control lines are formed to be substantially adjacent and parallel with each other.

3. The display device of claim 2, wherein at least parts of the first and second semiconductor layers are formed to be substantially parallel with each other.

4. The display device of claim 1, wherein the at least one of the pixel circuits further comprises:

a second transistor for diode-connecting the first transistor;

a third transistor having a first transistor electrode coupled to a first electrode of the first capacitor, and a second transistor electrode coupled to a second electrode of the first capacitor; and a second capacitor having a first capacitor electrode coupled to the second transistor electrode of the third transistor, and a second capacitor electrode coupled to a control electrode of the first transistor.

5. A display device including a plurality of scan lines provided in a first direction for transmitting select signals, a plurality of data lines provided in a second direction for transmitting data signals, and a plurality of pixel circuits respectively coupled to the scan lines and the data lines, wherein at least one of the pixel circuits comprises:

a first capacitor for charging a voltage corresponding to one of the data signals;

a first transistor having a control electrode coupled to a first capacitor electrode of the first capacitor, and a first electrode coupled to a second capacitor electrode of the first capacitor, the first transistor outputting a current corresponding to the voltage charged in the first capacitor;

a first emit element, a second emit element, and a third emit element for outputting light corresponding to the current output by the first transistor;

a first emit control transistor coupled between the first transistor and the first emit element;

a second emit control transistor coupled between the first transistor and the second emit element;

a third emit control transistor coupled between the first transistor and the third emit element;

a first emit control line coupled to a control electrode of the first emit control transistor;

a second emit control line coupled to a control electrode of the second emit control transistor; and a third emit control line coupled to a control electrode of the third emit control transistor, wherein a first semiconductor layer for forming the first emit control transistor, a second semiconductor layer for forming the second emit control transistor, and a third semiconductor layer for forming the third emit control transistor are branched from a fourth semiconductor layer for forming the first transistor and are formed as a single body with the fourth semiconductor layer.

6. The display device of claim 5, wherein at least parts of the first, second, and third semiconductor layers are formed to be substantially parallel with each other so that the first, second, and third semiconductor layers in a plane has a substantial m shape.

7. The display device of claim 5, wherein the first transistor comprises a p-channel transistor, and the emit control transistors comprise p-channel transistors.

8. The display device of claim 5, wherein the first transistor comprises a p-channel transistor, and the emit control transistors comprise n-channel transistors.

9. The display device of claim 8, wherein the display device further comprises a junction electrode and a contract hole and wherein the junction electrode is formed at an edge region of the fourth semiconductor layer and the first, second, and third semiconductor layers through the contact hole, and a current output by the first transistor is transmitted to the emit control transistors through the junction electrode.

10. A display panel including, in an array format, a plurality of scan lines provided in a first direction for transmitting select signals, a plurality of data lines provided in a second direction for transmitting data signals, and a plurality of pixel circuits respectively coupled to the scan lines and the data lines, wherein at least one of the pixel circuits comprises:

a capacitor for charging a voltage corresponding to one of the data signals;

a first transistor having a control electrode coupled to a first capacitor electrode of the capacitor, and a first electrode coupled to a second capacitor electrode of the capacitor, the first transistor outputting a current corresponding to the voltage charged in the capacitor;

a first emit element and a second emit element for outputting light corresponding to the current output by the first transistor;

a first emit control transistor coupled between the first transistor and the first emit element;

a second emit control transistor coupled between the first transistor and the second emit element;

a first emit control line coupled to a control electrode of the first emit control transistor and arranged to be substantially parallel with at least one of the scan lines; and a second emit control line coupled to a control electrode of the second emit control transistor and arranged to be substantially parallel with the at least one of the scan lines;

wherein a pixel area in which the at least one of the pixel circuits is arranged comprises:

a semiconductor layer including a first semiconductor layer region for forming the first transistor, a second semiconductor layer region for forming the first emit control transistor, and a third semiconductor layer region for forming the second emit control transistor, the second and third semiconductor layer regions being branched from the first semiconductor layer region and formed as a single body with the first semiconductor layer region;

a first insulation layer formed on the semiconductor layer;

a metallic layer formed on a portion of the first insulation layer on the second and third semiconductor layer regions, and including a first metallic layer region for forming the first emit control line and a second metallic layer region for forming the second emit control line; and a second insulation layer formed on the first insulation layer and the metallic layer.

11. The display panel of claim 10, wherein the first and second emit control lines are arranged to be substantially adjacent and parallel with each other, and at least parts of the second and third semiconductor layer regions are arranged to be substantially parallel with at least one of the data lines.

12. The display panel of claim 10, wherein regions other than a channel region of the second and third semiconductor layer regions are doped with p+ impurities.

13. The display panel of claim 10, wherein regions other than a channel region of the second and third semiconductor layer regions are doped with n+ impurities.

14. The display panel of claim 13, wherein the pixel area in which the at least one of the pixel circuits is arranged further comprises a contact hole for penetrating the first and second insulation layers and a junction electrode and wherein the contact hole is formed at an edge of the second and third semiconductor layer regions and the first semiconductor layer region, and the junction electrode is formed within the contact hole.

15. A display panel including, in an array format, a plurality of scan lines provided in a first direction for transmitting select signals, a plurality of data lines provided in a second direction for transmitting data signals, and a plurality of pixel circuits respectively coupled to the scan lines and the data lines, wherein at least one of the pixel circuit comprises:

a capacitor for charging a voltage corresponding to one of the data signals;

a first transistor for outputting a current corresponding to the voltage charged in the capacitor;

a first emit element, a second emit element, and a third emit element for outputting light of different colors based on the current output by the first transistor;

a first emit control transistor coupled between the first transistor and the first emit element;

a second emit control transistor coupled between the first transistor and the second emit element;

a third emit control transistor coupled between the first transistor and the third emit element;

a first emit control line coupled to a control electrode of the first emit control transistor;

a second emit control line coupled to a control electrode of the second emit control transistor; and a third emit control line coupled to a control electrode of the third emit control transistor, wherein a pixel area in which the at least one of the pixel circuits is arranged comprises:

a semiconductor layer including a first semiconductor layer region for forming the first transistor, a second semiconductor layer region for forming the first emit control transistor, a third semiconductor layer region for forming the second emit control transistor, and a fourth semiconductor layer region for forming the third emit control transistor, the second, third, and fourth semiconductor layer regions being branched from the first semiconductor layer region and formed as a single body with the first semiconductor layer region;

a first insulation layer formed on the semiconductor layer;

a metallic layer formed on a portion of the first insulation layer on the second, third, and fourth semiconductor layer regions, and including a first metallic layer region for forming the first emit control line, a second metallic layer region for forming the second emit control line, and a third metallic layer region for forming the third emit control line; and a second insulation layer formed on the first insulation layer and the metallic layer.

16. The display panel of claim 15, wherein at least parts of the second, third, and fourth semiconductor layer regions are arranged to be substantially parallel with at least one of the data lines.

* * * * *

UNITED STATES PATENT AND TRADEMARK OFFICE

CERTIFICATE OF CORRECTION

PATENT NO. : 7,518,579 B2
APPLICATION NO. : 11/112788
DATED : April 14, 2009
INVENTOR(S) : Won-kyu Kwak et al.

It is certified that error appears in the above-identified patent and that said Letters Patent is hereby corrected as shown below:

| | |
|---|---|
| Column 15, line 60, Claim 6 | Delete "has" and insert -- have -- |
| Column 17, line 12, Claim 15 | Delete "circuit" and insert -- circuits -- |

Signed and Sealed this

Twenty-first Day of September, 2010

David J. Kappos

David J. Kappos
*Director of the United States Patent and Trademark Office*